US005234107A

United States Patent [19]

Morel et al.

[11] Patent Number: 5,234,107

[45] Date of Patent: Aug. 10, 1993

[54] STACKABLE CONTAINER REMOVABLY SECURABLE TO A DISPLAY CARD

[75] Inventors: Daniel Morel; Serge Blais, both of Drummondville; Benoit Tremblay, Chambly, all of Canada

[73] Assignee: Plastichange International Inc., St-Bruno-de-Montarville, Canada

[21] Appl. No.: 878,413

[22] Filed: May 4, 1992

[51] Int. Cl.[5] ..... B65D 73/00

[52] U.S. Cl. ..... 206/462; 206/470; 206/467

[58] Field of Search ..... 206/461, 462, 470, 806, 206/508, 467; 229/2.5 R; 220/4.22, 4.23

[56] References Cited

U.S. PATENT DOCUMENTS

| | | | |
|---|---|---|---|
| 2,884,127 | 4/1959 | Neary | 206/462 |
| 2,931,493 | 4/1960 | Pfohl | 206/462 |
| 3,111,220 | 11/1963 | Bostrom | 206/462 |
| 3,463,309 | 8/1969 | Szostek | 206/470 |
| 4,013,214 | 3/1977 | Hansen et al. | 220/4.22 |
| 4,016,972 | 4/1977 | Szamborski | 206/470 |
| 4,124,953 | 11/1978 | Patton | 206/462 |
| 4,202,464 | 5/1980 | Mohs et al. | 229/2.5 R |
| 4,681,223 | 7/1987 | Roberts | 206/470 |
| 4,724,964 | 2/1988 | Hernandez | 206/470 |
| 4,753,351 | 6/1988 | Guillin | 229/2.5 R |
| 4,753,366 | 6/1988 | Ritter | 220/4.23 |
| 4,787,527 | 11/1988 | Monetti | 229/2.5 R |
| 4,807,747 | 2/1989 | Hadtke | 206/470 |
| 4,840,275 | 6/1989 | Faiola et al. | 206/462 |
| 5,018,622 | 5/1991 | Hartley | 206/470 |
| 5,131,551 | 7/1992 | Wells | 229/2.5 R |

FOREIGN PATENT DOCUMENTS

| | | | |
|---|---|---|---|
| 656966 | 1/1963 | Canada | 206/462 |
| 3407123 | 8/1985 | Fed. Rep. of Germany | 206/461 |
| 1507828 | 5/1974 | United Kingdom | 206/462 |

OTHER PUBLICATIONS

The Packaging Reference Issue, "Thermoformed Card Pack Constructions", vol. 31, No. 4 1986.

*Primary Examiner*—David T. Fidei

[57] ABSTRACT

A stackable container is disclosed which is removably secured to a display card. The container is molded from thin flexible sheet of transparent thermoplastic material and is provided with retention tabs on the side wall of the receptacle portion of the container whereby the container can be disposed in snap retention fit within an opening formed in the display card. The display card contains information carrying means while the container cover is free of printed material to fully expose the product contained therein. The cover of the container is hinged to the receptacle portion, and has a recessed top wall portion for captive stacking of a plurality of these containers. The recessed top wall has a contour vertical wall which is dimensioned for friction fit in a recess inner circumferential ledge of the receptacle.

8 Claims, 2 Drawing Sheets

STACKABLE CONTAINER REMOVABLY SECURABLE TO A DISPLAY CARD

BACKGROUND OF INVENTION

The present invention relates to a stackable container which is removably securable to a display card so that the display card and the container may each be separated from one another and reused or reprocessed by recycling.

It is known to attach reusable containers to a display card, such as disclosed in U.S. Pat. No. 4,724,964. However, these known combination of elements usually include an adhesive band or tape to secure the container to the card with the tape often carrying some printed information and extending over the front wall of the container thereby obstructing view to the product in the container. U.S. Pat. No. 4,840,275 discloses another embodiment wherein the container is an open top end container secured in one flap of a card with the container being sealed by the other flap of the card which contains an adhesive tab to secure the flaps together. Again, the securement is made with adhesive means.

U.S. Pat. No. 2,931,494 discloses a plastic container secured to an advertisement card wherein one or more articles may be removed and replaced from the card as they are sold. The articles are retained by recesses formed in the outer walls of the container. With these containers only a single article is secured therein in close fit with the container, as the back portion of the container has an opening which is maintained in a restricted condition to secure the product in the container while engaged with the display card. Another disadvantage of such containers and card is that once the container is removed from the card the opening in the display card is damaged, and a replaced container may not securely hold its product therein causing damage to the product and to the display card.

SUMMARY OF INVENTION

It is a feature of the present invention to provide an improved container construction for use in combination with a display card, and wherein the container is of the stackable type.

Another feature of the present invention is to provide a stackable container for removable securement to a display card, and wherein the container is formed of thermoplastic transparent material, and the display card is formed of recyclable material.

Another feature of the present invention is to provide a stackable container for removable securement to a display card which is formed of plastics material, and contains removable advertisement material so that the containers carrying different products may be substituted in a display card with the advertisement material of the card changed to coincide with the new product contained within the container.

Another feature of the present invention is to provide a stackable container for removable securement to a display card wherein the display card is dimensioned to deter theft.

Another feature of the present invention is to provide a stackable container for removable securement to a display card, wherein the cover of the container has a recessed top wall and wherein the product contained within the container is visible from the recessed top wall which does not contain any obstructing material.

According to the above features, from a broad aspect, the present invention provides a stackable container for removable securement to a display card. The container comprises an open top end receptable portion having a bottom wall and a contour side wall, and an integrally molded cover secured thereto through a hinge formed along an upper straight side edge of the side wall. The receptacle portion has a recessed inner circumferential ledge adjacent the top end thereof. The ledge has a tapered side wall and a flat outer contour flange about a top edge thereof. The cover is molded from a flat sheet of transparent plastics material, and defines a recessed top wall portion for captive stacking of a plurality of the containers. The recessed top wall has a contour vertical wall dimensioned for friction fit in the recessed inner circumferential ledge when the cover is press-fitted over the open top end to close the receptacle portion. The cover also has a flat flange about the recessed top wall for flush abutment over the outer flat contour flange of the receptacle portion, and to strengthen the receptacle side wall. An outer portion of the contour flanges of the receptacle or the cover opposite from the hinge has finger engaging means to permit the cover to be disconnected from the receptacle for access thereinto. A plurality of retention tabs are formed in the side wall of the receptacle and disposed in the tapered side wall of the circumferential ledge for snap retention of the container in an opening formed in the display card. The display card contains information carrying means identifying a product disposed in the container.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
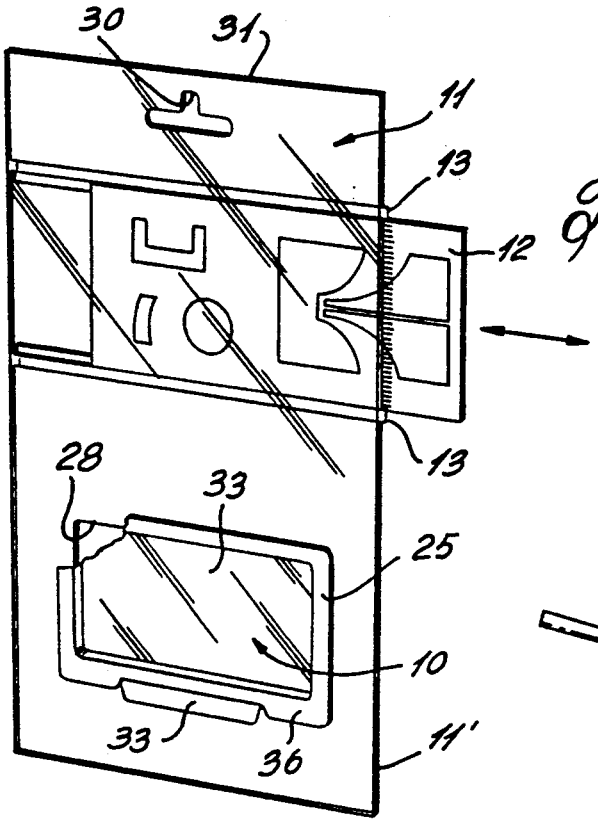
FIG. 1 is a perspective view showing the stackable container of the present invention removably secured within a display card, and wherein advertisement material is also removably secured to the display card.
Figure 2:
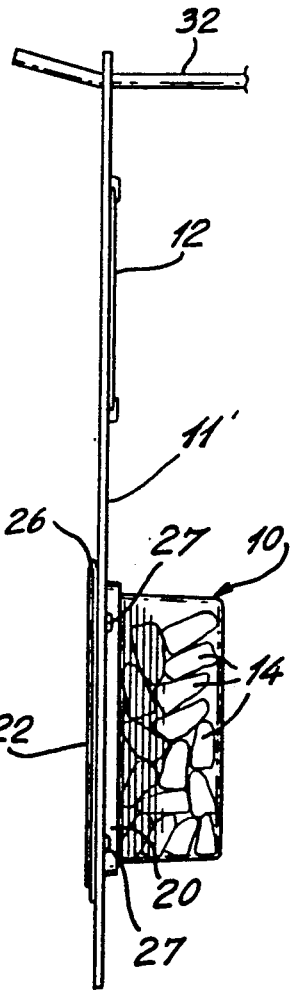
FIG. 2 is a side view of FIG. 1.
Figure 3:
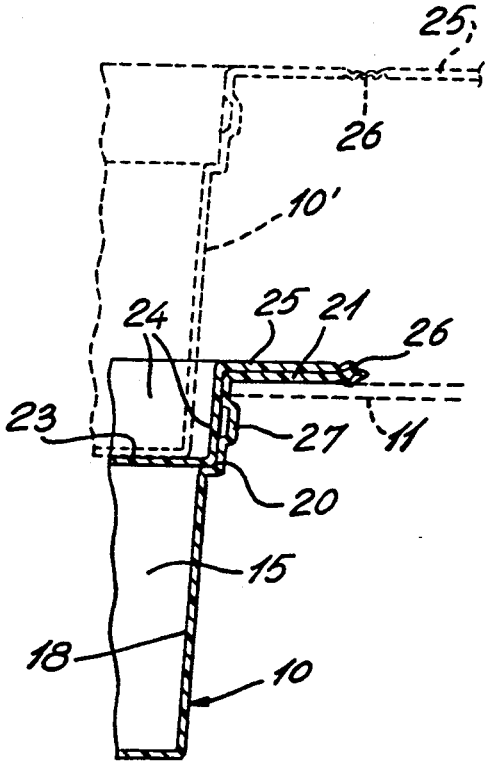
FIG. 3 is a fragmented, partly sectioned view of the container showing its attachment to the display card and the stackable feature thereof.

Referring now to the drawings, and more particularly to FIGS. 1 to 3, there is shown at 10 the stackable container of the present invention which is removably secured to a display card 11. The display card may be constructed of cardboard or other recyclable material, or else of plastics material as herein shown. The display card herein shown also has a removable advertisement display card 12 which is slidingly secured between channel flanges 13 formed in the back wall 11' of the display card so that the advertisement display card can be changed to correlate with the product 14 which is retained within the container 10, as shown in FIG. 2. Of course, if the display card is made of cardboard, the advertisement would be printed on the face of the card. The display card is also preferably, but not exclusively, dimensioned to detract theft by making it of a size sufficiently large to make it difficult to insert in the pocket of an article of clothing. Once the purchaser buys the product, the card may be detached from the container at the point of sale, and the card recycled or reused with another container, or a container containing a different product inserted in the display card with the advertisement of the card changed, as described above.

Figure 4:
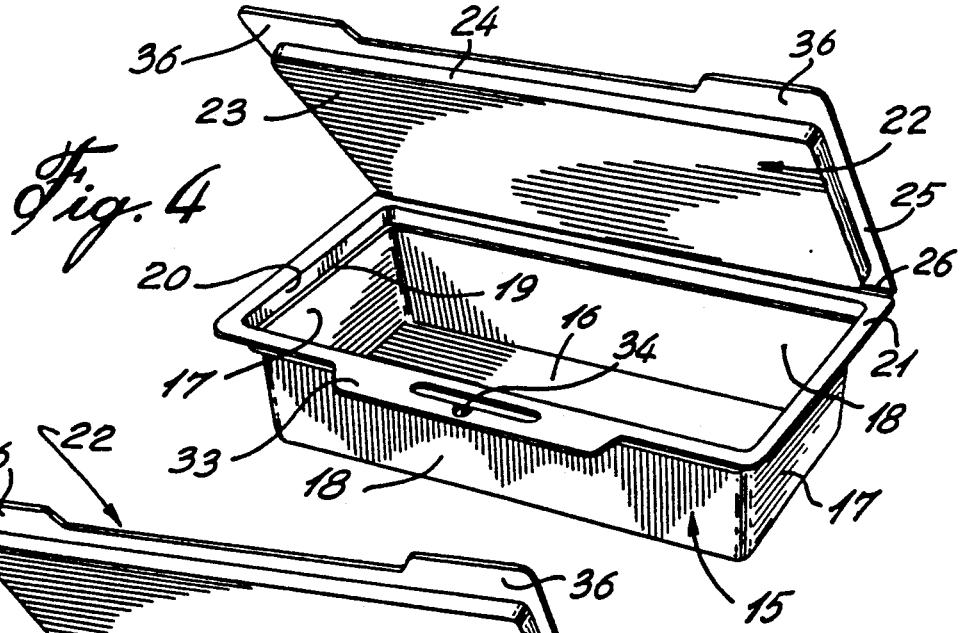
FIG. 4 is a perspective view of the stackable container of the present invention.

Referring now additionally to FIG. 4, there will be described the construction of the container. The container herein shown is molded from a thin flexible sheet of transparent thermoplastic material so that the product is visible within the container from all sides thereof. The container could also be formed of plastic having a colored pigment or else painted. Information could also be printed on the cover. The container is rectangular, but could also be of other shaped configuration.

The container comprises a receptacle portion 15 having a bottom wall 16 and opposed side walls, herein end walls 17 and opposed side walls 18 which are of rectangular shape and which taper downwardly towards the bottom wall. The receptacle portion is provided with a recessed inner circumferential ledge 19 adjacent the open top end of the receptacle. The ledge has a slight tapered side wall 20 and a flat outer contour flange 21 all about the container receptacle portion 15.

A cover 22 is molded from the flat sheet of plastics material and defines a recessed top wall portion 23 for captive stacking of a plurality of the containers, as shown in FIG. 3, with container 10' being stacked on top of container 10 and captive by the contour vertical wall 24 forming the recess. The contour vertical wall 24 is also tapered and dimensioned for friction fit in the recessed inner circumferential ledge, as shown in FIG. 3, when the cover 22 is press-fitted over the open top end of the receptacle portion 15 to close the receptacle portion. The cover 22 also has a flat circumferential flange 25 about the recessed top wall for flush abutment over the outer flat contour flange 21 of the receptacle portion. The flange 21 also strengthens the receptacle side walls 17 and 18 while the flange 25 strengthens the contour vertical wall 24.

The cover 22 is secured to the outer contour flange 21 of one of the opposed side walls 18 through an integrally formed accordion hinge formation as shown at 26 in FIG. 3 with the cover in its closed position, and as shown at 26' with the cover in its open condition. This hinge is located at the end of the flange and permits for the circumferential flange 25 of the cover to be in contact entirely about the flange 21 of the receptacle portion. This provides for the cover to be in tight frictional contact within the receptacle so as not to detach when positioned on the display card, as shown in FIG. 1.

A plurality of retention tabs 27 are also integrally molded in the contour vertical wall 24 of the inner circumferential ledge 19 in order to provide a removable securement means for the container within the display card 11. The display card is provided with an aperture 28 which is configured to receive the container receptacle portion 15 in close fit therein, so that by pressing the container within the card, the retention tabs 27 lock the container about the aperture 28, as shown in FIG. 3. Because these tabs are small in dimension as shown in FIG. 2, the aperture is not damaged when the container is removed, as the vertical wall 24 of the ledge 19 will flex to permit removal, or the display card will flex accordingly. The side walls 17 and 18 of the receptacle portion are also tapered, as mentioned hereinabove, and this facilitates inserting the receptacle portion of the container within the aperture 28.

Figure 5:
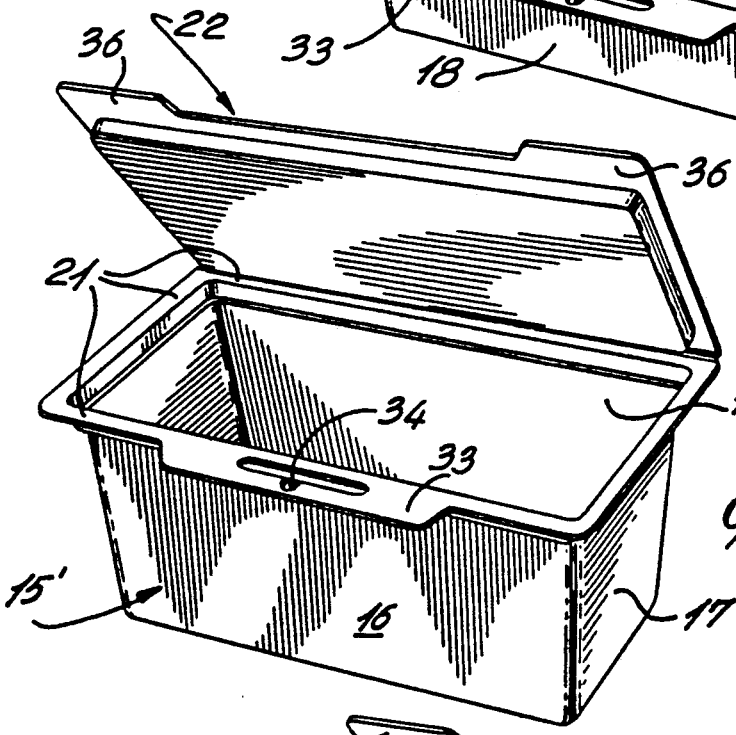
FIG. 5 is a perspective view showing a modification of a stackable container of FIG. 4.

As shown in FIG. 1, the display card is also provided with holding means, herein a hanging aperture 30, formed below a top edge 31 of the display card to permit the card to be held on pegs or support rods 32 secured to a display rack (not shown). Similarly as shown in FIGS. 4 and 5, the container may be provided with a central flange extension 33, also having a hanging aperture 34 formed therein, with the extension 33 being provided in the outer contour flange 21 of the receptacle portion opposite the hinge 26 so that the container may also be hung on support rods or pegs 32. The flange extension portion 33 also constitutes a finger engaging means to detach the cover from the receptacle portion, as this permits separation of the contour flanges 21 and 25 to remove the cover from friction fit retention. The circumferential flange 25 of the cover may also be provided with opposed extension end portions 36 which extend on each side of the central extension portion 33 to constitute the finger engaging means to facilitate separation, as both the extensions 33 and 36 would extend beyond the outer edge of the opposed flanges 21 or 25.

Figure 6:
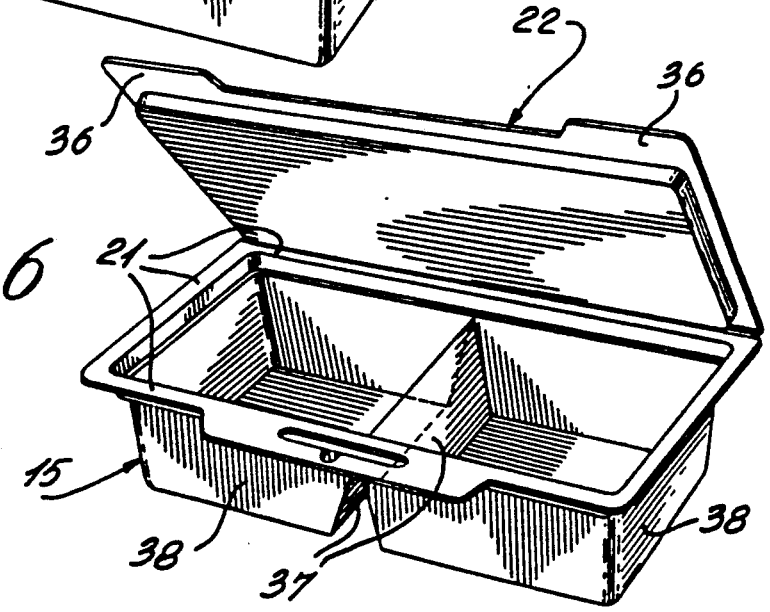
FIG. 6 is a further perspective view showing a further modification of the stackable container of FIG. 4.

As shown in FIGS. 5 and 6, the container of FIG. 4 may be modified wherein the receptacle portion 15 can be of a much larger size as at 15'. Alternatively, the receptacle container portion 15 may have a division partition 37 to form two distinct inner compartments 38 therein for the storage of different products or complementary products, such as screws, bolts, anchoring plugs, etc.

It is within the ambit of the present invention to cover any obvious modifications of the preferred embodiment described herein, provided such modifications fall within the scope of the appended claims. The container or the display card as disclosed herein may have other advantages not mentioned, such as providing different advertising display material in the display card which coincides with holidays, such as Christmas, etc. to provide a display having a different advertising characteristic. The containers and display cards may also have a larger dimension than that usually found in hardware stores, and the container may contain various products, such as nylon stockings, and other articles of clothing, jewelry, fishing lures and accessories, etc. If the display card is of the reusable type, it may also contain an insert which would trigger an audible alarm should the display card be taken out of restricted premises having detecting means at the exits thereof.

We claim:

1. A stackable container removably secured in an opening provided in a surface of a display article, said container comprising an open top end receptacle portion having a bottom wall, a contour side wall and an integrally molded cover secured thereto through a hinge formed along an upper straight side edge of said side wall, said receptacle portion having a recessed inner circumferential ledge adjacent said top end thereof, said ledge having a tapered side wall and a flat outer contour flange about a top edge thereof, said cover being molded from a flat sheet of transparent plastics material and defining a recessed top wall portion for captive stacking of a plurality of said containers, said recessed top wall having a contour vertical wall dimensioned for friction fit in said recessed inner circumferential ledge when said cover is press-fitted over said open top end to close said receptacle portion, said cover also having a flat flange about said recessed top wall for flush abutment over said outer flat contour flange of said receptacle portion and to strengthen the receptacle side wall, an outer portion of said contour flanges of said receptacle or said cover opposite from said hinge having finger engaging means to permit said cover to be disconnected from said receptacle for access thereinto, a plurality of retention tabs formed in said side wall of said receptacle and disposed in said tapered side wall of said circumferential ledge for snap-retention of said container in said opening formed in said surface of said display article, said recessed top wall portion of said cover having a straight contour vertical wall, said hinge being formed by an accordion embossed strip disposed outwardly of a flat flange along said side wall of said receptacle, said finger engaging means being comprised by one or more flange extension portions formed in said outer portion of said contour flange opposite from said hinge, said flange extension being a central extension portion formed in said flange of said receptacle and having a hanging aperture therein for attaching said container independently of said display article.

2. A stackable container as claimed in claim 1 wherein said receptacle is a rectangular receptacle having a rectangular bottom wall and opposed side walls, said recessed top wall portion of said cover being a rectangular recess having opposed straight contour vertical walls, said hinge being formed by an accordion embossed strip disposed outwardly of a flat flange along one of said side walls of said receptacle.

3. A stackable container as claimed in claim 1 wherein said container is molded from a thin flexible sheet of transparent thermoplastic material whereby said product disposed in said container is visible.

4. A stackable container as claimed in claim 3 wherein said display article is a display card constructed of plastics material, said display card having an information carrying means in the form of a removable insert positionable in retention means to permit said information carrying means to be replaced, and holding means for supporting said card in a display rack.

5. A stackable container as claimed in claim 1 wherein said display article is a cardboard card having information carrying means printed thereon, and holding means for supporting said card in a display rack, said cardboard card being a recyclable product, and said container being a reusable container.

6. A stackable container as claimed in claim 3 wherein said receptacle is molded with a division partition to form two distinct inner compartments therein.

7. A stackable container as claimed in claim 1 wherein said receptacle is a rectangular receptacle having a rectangular bottom wall and opposed side walls, said flange of said cover having an extension on opposed ends thereof to each side of said central extension portion to constitute said finger engaging means.

8. A stackable container as claimed in claim 1 wherein said display article is a reusable card and dimensioned to prevent theft of said container, said card containing information carrying means identifying a product disposed in said container, said container being detached from said card at the point of sale of said container to permit said card to be reused.

* * * * *